US005522138A

United States Patent [19]

Betts, Jr.

[11] Patent Number: 5,522,138

[45] Date of Patent: Jun. 4, 1996

[54] SWINGABLE LEVER FOLDING KNIFE

[76] Inventor: Lee E. Betts, Jr., 1307 B. Radcliff, Austin, Tex. 78752

[21] Appl. No.: 157,883

[22] Filed: Nov. 24, 1993

[51] Int. Cl.[6] ..... B26B 1/04

[52] U.S. Cl. ..... 30/160; 30/158; 30/161

[58] Field of Search ..... 30/155, 158, 159, 30/160, 161, 143, 330, 331, 153

[56] References Cited

U.S. PATENT DOCUMENTS

| | | | |
|---|---|---|---|
| 412,799 | 10/1889 | Schenck | 30/158 |
| 689,513 | 12/1901 | Papendell | 30/158 |
| 1,665,955 | 4/1927 | Gatewood . | |
| 3,702,501 | 11/1972 | Wood | 30/153 |
| 4,124,939 | 11/1978 | Onoue | 30/161 |
| 4,364,174 | 12/1982 | DeAssis | 30/153 |
| 5,060,379 | 10/1991 | Neely | 30/161 |

FOREIGN PATENT DOCUMENTS

| | | | |
|---|---|---|---|
| 7228 | 4/1893 | United Kingdom | 30/158 |
| 699500 | 11/1953 | United Kingdom | 30/158 |

*Primary Examiner*—Hwei-Siu Payer
*Attorney, Agent, or Firm*—Conley, Rose & Tayon

[57] ABSTRACT

A folding knife (2) including a blade (6) foldable between an elongated handle (4) wherein blade (6) has a pivotal axis at one end of handle (4). An elongated lever (2) has one end pivotally hinged to the edge of blade (6) on one side transversely spaced from the pivotal axis of blade (6) having a squared end block (60) of blade (6) extending rearwardly therefrom therein handle (4), the upper and lower side of end block (60) are flat. The opposite length of lever (20) extend parallel and spaced apart to at least the length of blade (6) adjacent a cutting edge (24) of blade (6) upon handle (4). Lever (20) is configured with a hump (26) which abuts with blade (6) rearwardly of cutting edge (24) to retain the spacing between lever (20) and cutting edge (24).

The free end of lever (20) is swingable in a circular motion in the plane of blade (6) to either side of handle (4) with respect to the pivotal axis of blade (6) to move blade (6) back and forth between its stored position and exposed position projecting linearly from the end of handle (4). The end of lever (20) is securable on either side of handle (4) with a lock (28) at that end of handle (4) to secure blade (6) in it stored or exposed position.

20 Claims, 1 Drawing Sheet

SWINGABLE LEVER FOLDING KNIFE

BACKGROUND

1. Field of Invention

This invention relates to folding knives, specifically to such folding knives which are rapidly activated, yet easily stored in the pocket or purse of the user.

2. Description of the Relevant Art

As will be readily apparent to those skilled in the art, folding knives come of many varieties, as for field use, hunting, fishing, or just utility in general, and in many shapes and sizes.

As is also apparent, folding knives of the type in present use are provided with many methods of rapidly activating their blades, such as the type which is spring loaded, thereby applying manual force upon a release mechanism causes the blade to automatically be activated, however, this type of knife is limited to spring tension as to how rapidly it can be activated. Consumers of folding knives for rapid activation would prefer a folding knife rather controllable by the skill of the user to rapidly manipulate their folding knife to an active position, rather than rely on the limitations of spring tension.

There have been other arrangements for rapidly activating folding knives, such as the butterfly type. This type knife has a blade foldable between the sides of a pair of handles, which are secured to one another with a latch at the end of the handles. Although this type knife can be rapidly activated dependent on the skill of the user, however the skill required to activate the blade properly may be considerably difficult for average users of folding knives.

SUMMARY OF THE INVENTION

The present invention avoids and overcomes the problem encountered with prior art inventions. In a preferred embodiment 7 the invention may comprise a handle, defined by a pair of elongated side surfaces aligned parallel to one another. The handle may support a blade, which may be pivotally attached between one end of the handle and extending a considerable length there between having at least the opposite end of the blade terminating inside the handle. The blade may include a dip at a location in the edge of the blade on one side just inwardly adjacent the pivotal axis of the blade. The handle may also include a crescent like blade stop having one side of the blade stop rounded, and having an flat end on the opposite side of the blade stop. The blade stop may be attached between the handle at a location so that the rounded portion of the blade stop engages in the dip of the blade, to limit the inward movement of the blade from movement from one side of the handle.

The blade may include a support bracket at a location transversely spaced from the pivotal axis of the blade at the edge of the blade, on the opposite side of the blade from the dip. The support bracket may be defined by a pair of side surfaces extending parallel to one another in the plane of the blade from the edge thereof. The support bracket may pivotally support one end of an elongated lever, having the opposite length of the lever extend parallel and spaced apart to at least the length of the blade adjacent a cutting edge of the blade, upon the handle. The lever may also be configured with a hump which may abut with the blade just rearwardly of the cutting edge, which may retain the spacing between the lever and the cutting edge.

The blade may also include an end block which is the end portion of the blade which extends rearwardly from the support bracket inside the handle, the upper and lower portions of the end block may be flat.

Still further the present invention may include a lock, located at the opposite end of the handle from the pivotal axis of the blade, adjacent the end of the cutting edge of the blade, and the end of the lever which is spaced apart from the end of the blade. The lock may include an end brace located at the outermost end of that end of the handle therein the handle. The end brace may include a pair of stems which project parallel and space apart from one another, from the inner most side of the end brace therein the handle. The lock may also include a crossbar which extends transversely across and beyond each side of the width of that end of the handle, at a location adjacent the stems of the end brace therein the handle. The crossbar may be pivotally attached at a central location of the crossbar to the handle having equal lengths of the crossbar extend in each direction from the pivotal axis of the crossbar. The crossbar may also include a pair of recesses adjacent each of the stems of the end brace.

There may also be a pair of coil springs interposed between the insides of each of the recesses and the end brace, having the stems of the end brace pass partially axially into the corresponding spring. The springs may provide equal resilient force upon each end of the crossbar to resiliently retain the crossbar in a generally horizontal position with regards to the handle. The crossbar may yet include a pair of latches projecting parallel to one another and spaced apart, on the opposite side of the crossbar from the recesses therein the handle. At least one of the latches may interlock with at least one side of a catch groove of the lever, located at the end of the spaced apart end of the lever to secure the lever in the position adjacent the cutting edge of the blade upon the handle.

In further reference to the preferred embodiment of the invention, the lever may include a finger loop, which maybe defined as circular grooves on each side of the lever just inwardly adjacent the catch groove of the lever, on each side of the lever that are gradient downwardly and inwardly to the same hole.

In one aspect of the present invention, by grasping the finger loop of the lever and applying a manual inward force upon the lever, while simultaneously applying a manual downward force upon the end of the crossbar which extend beyond the side of the handle on the opposite side from the lever, may cause the latch of the crossbar on the side securing the lever, to move upwardly from the catch groove of the lever. Upon releasing the lever from the lock allows pivotal movement of the lever to be manually moved outwardly in the plane of the blade in a circular motion from the handle, the lever may engage with the lower portion of the end block of the blade at a position having the lever extending rearwardly from the blade. Upon continued movement of the lever upon engaging with the end block of the blade may cause the blade to move outwardly from the handle. The lever may be able to continue movement upon engaging with the end block of the blade due to the pivotal axis of the blade and the blade moving along with the lever. Upon continued movement of the lever upon engaging with the end block of the blade, the movement of the lever may be continued to the opposite side of the handle therefore bringing the blade to a position projecting linearly from one end of the handle. The lever may be secured on that side of the handle with the latch on that side of the handle interlocking with the other side of the catch groove of the lever. As the lever is secured on that side of the handle the upper portion of the end block of the blade engages with the flat side of the blade stop, located on the opposite side of the blade stop from the rounded portion of the blade stop therein the handle, therefore the end block of the blade may be forcibly urged against the flat side of the blade stop with the lever to secure the blade in the position projecting linearly from the end of the handle.

Broadly speaking any manner of manipulating the lever to one side or the other of the handle may cause the blade to be activated or collapsed depending on the need of the user.

BRIEF DESCRIPTION OF THE DRAWINGS

The details of the invention will be described in connection with the accompanying drawings in which.

REFERENCE NUMERALS OF THE DRAWINGS

Figure 1:
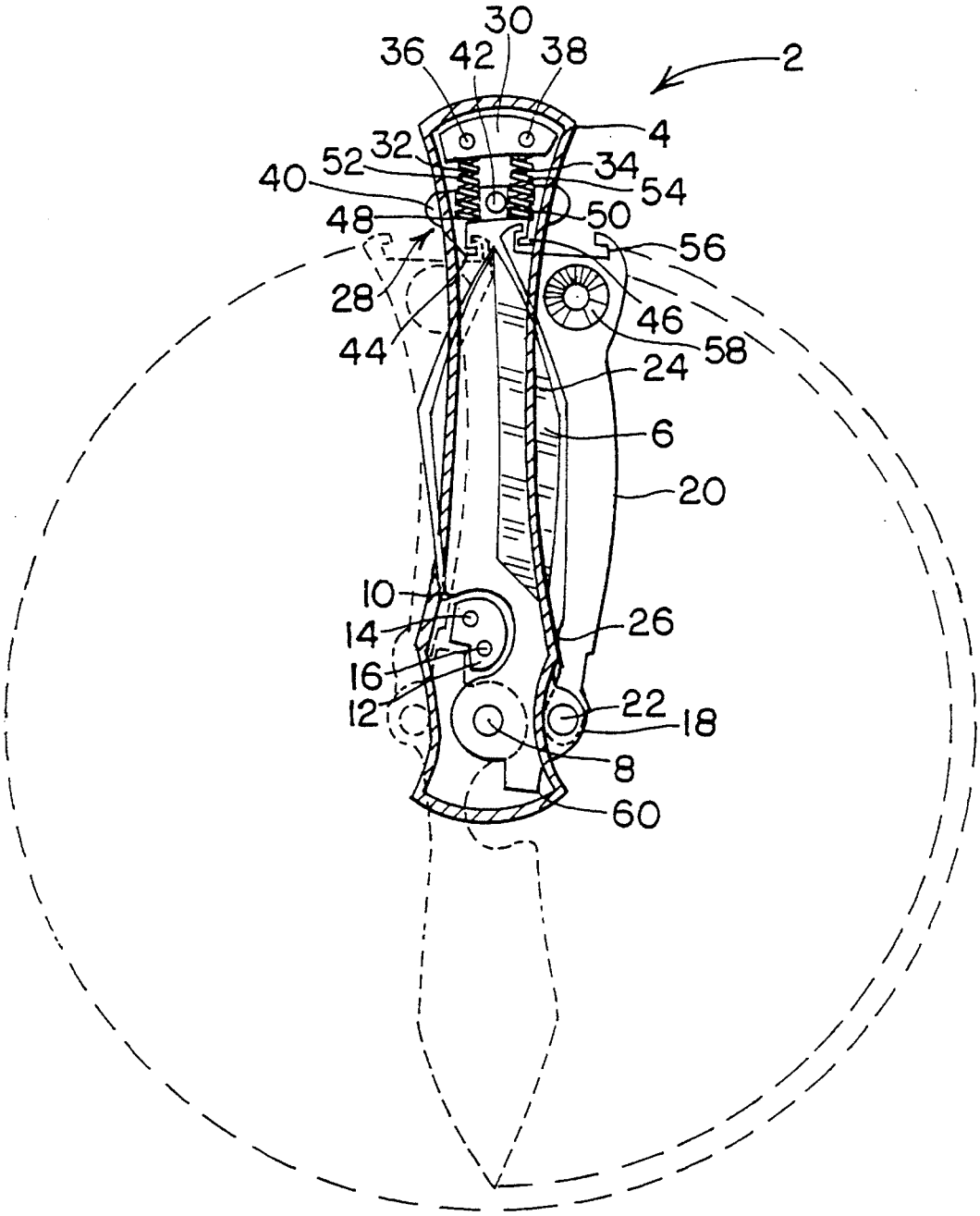
FIG. 1 is a side elevational view illustrating the swingable lever folding knife in accordance with the principle of this invention.

| | | |
|---|---|---|
| 2 folding knife | 4 handle | 6 blade |
| 8 pivot rod | 10 dip | 12 blade stop |
| 14 attaching pin | 16 attaching pin | 18 support bracket |
| 20 lever | 22 connecting rod | 24 cutting edge |
| 26 hump | 28 lock | 30 end brace |
| 32 stem | 34 stem | 36 connecting pin |
| 38 connecting pin | 40 crossbar | 42 pivotal rivet |
| 44 latch | 46 latch | 48 recess |
| 50 recess | 52 coil spring | 54 coil spring |
| 56 catch, groove | 58 finger loop | 60 end block |

DESCRIPTION OF THE PREFERRED EMBODIMENT

Referring to FIG. 1 there is shown a folding knife 2 in a generally folded configuration. As shown knife 2 includes a handle 4 which is generally defined by a pair of elongated metallic side surfaces aligned parallel to one another. FIG. 1 shows handle 4 supports a blade 6, having one end of blade 6 pivotally attached between one end of handle 4, and having at least the opposite end of blade 6 extending longitudinal to a considerable length therebetween. Blade 6 is pivotally attached to handle 4 with a metallic pivot rod 8 which has passage through aligned holes in handle 4 and blade 6 at that end of handle 4. The ends of rod 8 are malleable to be secured to handle 4.

In FIG. 1 showing on one side of blade 6 there is a dip 10 in the edge of blade 6 at a location just inwardly adjacent rod 8. As shown a metallic crescent like blade stop 12, as shown one side of blade stop 12 is rounded and the opposite side is flat at one end. Blade stop 12 is attached between handle 4 having the round side of blade stop 12 engaging in dip 10 of blade 6 to limit the inward movement of blade 6 from movement from one side of handle 4. Blade stop 12 is attached to handle 4 with a pair of metallic attaching pins 14 and 16, which has passage through a set of aligned holes in at least one side of handle 4 and blade stop 12 at that location. The ends of attaching pins 14 and 16 are also malleable to secure blade stop 12 to handle 4.

FIG. 1 shows a support bracket 18 transversely spaced from rod 8 on the opposite side of blade 6 from dip 10 at the edge thereof. Support bracket 18 is generally defined by a pair of side surfaces aligned parallel extending from the edge of blade 6 in the plane of blade 6 at that location.

As shown in FIG. 1 an elongated metallic lever 20 having one end of lever 20 pivotally connected between support bracket 18 with a connecting rod 22 which has passage through aligned holes in both sides of support bracket 18 and a hole at that end of lever 20, the ends of connecting rod 22 can be malleably attached to the outsides of support bracket 18 to secure lever 20 to blade 6. The opposite length of lever 20 extends parallel and spaced apart to at least the length of blade 6 adjacent a cutting edge 24 of blade 6 upon handle 4. Lever 20 is also configured with a hump 26, which abuts with blade 6 at a location rearwardly of cutting edge 24 to retain the spacing between cutting edge 24 and lever 20.

In FIG. 1 showing a lock 28 between the end of handle 4 adjacent the spaced apart ends of lever 20 and blade 6. As shown lock 28 includes a metallic end brace 30 which is located between the outermost end of that end of handle 4. End brace 30 includes a pair of short stems 32 and 34 which project parallel and spaced apart from one another from the inner side of brace 30. End brace 30 would be attached to the end of handle 4 with a pair of connecting pins 36 and 38 which has passage through a set of align holes in end brace 30 and handle 4. Connecting pins 36 and 38 are malleable to be secured to handle 4.

Lock 28 also includes a metallic crossbar 40 aligned parallel and spaced apart from stems 32 and 34 of end brace 30 in handle 4. Crossbar 40 extends transversely across and beyond the width of each side of handle 4 at that location. Crossbar 40 is pivotally attached to handle 4 with an intermediate pivotal rivet 42 which has passage through aligned holes centrally through the sides of handle 4 and centrally through crossbar 40 at that end of handle 4. Crossbar 40 includes a pair of latches 44 and 46 which project parallel and spaced apart from one another from the innermost side of crossbar 40, having at least the ends of crossbar 40 projecting from each side of handle 4 at that location. Crossbar 40 also includes a pair of recesses 48 and 50 located in crossbar 40 adjacent each of stems 32 and 34 of end brace 30. As shown in FIG. 1 a pair of coil springs 52 and 54 are interposed between the insides of recesses 48 and 50, and end brace 30. Stems 32 and 34 would pass partially axially into the ends of springs 52 and 54, to retain springs 52 and 54 in place between recesses 48 and 50 and end brace 30 of lock. 28. Springs 52 and 54 are to supply an equal resilient force to each side of crossbar 40.

In FIG. 1 showing the end of lever 20 which is spaced apart from the end of blade 6 includes a catch groove 56 which is an elongated groove at the end of lever 20. In FIG. 1 showing that one side of catch groove 56 interlocks with at least one of latches 44 or 46 of lock 28 while knife 2 of FIG. 1 is in the folded condition. Lever 20 also includes a finger loop 58 which is generally defined by a pair of circular grooves on each side of lever 20, at a location just inwardly of catch groove 56, each circular groove on each side of lever 20 are gradient downwardly and inwardly to the same hole.

Referring to FIG. 1 by applying a manual inward force upon lever 20 at finger loop 58, while simultaneously applying a manual downward force upon the end of crossbar 40 which extends beyond the side of handle 4 on the opposite side from lever 20 while knife 2 of FIG. 1 is in the folded condition, would cause latch 44 to move upwardly from that side of catch groove 56 therefore compressing spring 54, would free the end of lever 20 from lock 28. In FIG. 1 upon manually freeing the end of lever 20 from lock 28, the lever can be manually moved outwardly in a circular motion in the plane of blade 6 from handle 4 to the opposite side of handle 4, with respect to pivot rod 8 and to blade 6 moving simultaneously to a position projecting linearly from one end of handle 4 due to the lever engaging the lower side of an end block 60 which is a squared end of blade 6 that extends rearwardly from the end of blade 6. Lever 20 can be secured on that side of handle 4 with latch 44 on that side of handle 4 interlocking with the other side of catch groove 56 of lever 20. In FIG. 1 as lever 20 is secured on the opposite side of handle 4 the upper side of end block 60 engages with the flat end of blade stop 12 therein handle 4, therefore end block 60 would be entrapped between the flat end of blade stop 12 and lever 20 to secure blade 6 in the position projecting linearly from the end of handle 4.

Thus, while the invention has been described in connection with a certain embodiment, it will be apparent to those skilled in the art that many modifications of structure, arrangement, portions, elements, materials and components can be used in the practice of the invention without distorting from the principles of this invention.

I claim:

1. A folding knife, comprising:

an elongated handle comprising a first end, a second end, and a pair of spaced apart surfaces extending between the first end and the second end;

a blade with a first end, a second end, and a cutting edge, the first end of the blade being pivotally connected to the first end of the elongated handle such that the blade is extendable during use between a closed position located between the spaced apart surfaces of the elongated handle, and an open position substantially in line with the elongated handle;

an elongated lever with a first end and a second end, the first end being pivotally connected to the first end of the blade such that the lever is extendable during use between a first position substantially parallel to and adjacent to the surfaces along at least a majority of the length of the cutting edge of the blade when the blade is in the closed position, and a second position substantially parallel to and adjacent the surfaces of the handle and substantially in line with the blade when the blade is in the open position;

the elongated lever being connected to the blade such that moving the elongated lever from the first position to the second position during use moves the blade from the closed position to the open position.

2. The folding knife of claim 1, whereby the lever is connected such that the cutting edge of the blade is proximate but does not touch the lever when the blade is in the closed position and the lever is in the first position.

3. The folding knife of claim 1, whereby the blade further comprises a support bracket located proximate the first end of the blade, the first end of the lever being pivotably connected to the support bracket.

4. The folding knife of claim 1, wherein the blade is adapted to be rapidly moved from a closed position to an open position by a human hand grasping the lever and applying force thereto during use, the force causing the handle to move away from the blade during use.

5. The folding knife of claim 1, whereby the second end of the lever extends to at least the length of the blade.

6. The folding knife of claim 1, whereby the first end of the lever has a pivotal axis spaced apart from a pivotal axis of the blade, and the pivotal axis of the lever is located closer to the cutting edge of the blade than it is to an edge of the blade opposite the cutting edge of the blade.

7. The folding knife of claim 1, whereby the lever is connected to the blade such that the lever and the blade move simultaneously from the closed position to at least the open position of the blade during use.

8. The folding knife of claim 1, wherein cutting edge of the blade is proximate the elongated lever when the blade is in the closed position and the elongated lever is in the first position.

9. A folding knife, comprising:

an elongated handle comprising a first end, a second end, and a pair of spaced apart surfaces extending between the first end and the second end;

a blade with a first end, a second end, and a cutting edge, the first end of the blade being pivotally connected to the first end of the elongated handle such that the blade is extendable during use between a closed position located between the spaced apart surfaces of the elongated handle, and an open position substantially in line with the elongated handle;

an elongated lever with a first end and a second end, the first end being pivotably connected to the first end of the blade such that the lever is extendable during use between a first position substantially parallel to and adjacent to the surfaces of the handle and the blade when the blade is in the closed position, and a second position substantially parallel to and adjacent the surfaces of the handle and substantially in line with the blade when the blade is in the open position;

the elongated lever being connected to the blade such that moving the elongated lever from the first position to the second position during use moves the blade from the closed position to the open position; and further comprising a locking mechanism on the second end of the handle, the second end of the lever being adapted to lock into the locking mechanism when manually pressed against the locking mechanism.

10. The folding knife of claim 9, whereby the second end of the lever is adapted to lock into the locking mechanism when the lever is in both the first and second positions.

11. The folding knife of claim 9, whereby the lever has a catch groove at the end of the second end of the lever adapted to engage with the locking mechanism on the second end of the handle.

12. The folding knife of claim 9, wherein cutting edge of the blade is proximate the elongated lever when the blade is in the closed position and the elongated lever is in the first position.

13. A folding knife, comprising:

an elongated handle comprising a first end, a second end, and a pair of spaced apart surfaces extending between the first end and the second end;

a blade with a first end, a second end, and a cutting edge, the first end of the blade being pivotally connected to the first end of the elongated handle such that the blade is extendable during use between a closed position located between the spaced apart surfaces of the elongated handle, and an open position substantially in line with the elongated handle:

an elongated lever with a first end and a second end, the first end being pivotally connected to the first end of the blade such that the lever is extendable during use between a first position substantially parallel to and adjacent to the surfaces of the handle and the blade when the blade is in the closed position, and a second position substantially parallel to and adjacent the surfaces of the handle and substantially in line with the blade when the blade is in the open position;

the elongated lever being connected to the blade such that moving the elongated lever from the first position to the second position during use moves the blade from the closed position to the open position; and whereby the second end of the lever comprises a locking mechanism, the locking mechanism being adapted to lock into the second end of the handle when the lever is manually pressed against the second end of the handle.

14. The folding knife of claim 13, whereby the second end of the lever is adapted to lock into the locking mechanism when the lever is in both the first and second positions.

15. A folding knife, comprising:

an elongated handle comprising a first end, a second end, and a pair of spaced apart surfaces extending between the first end and the second end;

a blade with a first end, a second end, and a cutting edge, the first end of the blade being pivotally connected to the first end of the elongated handle such that the blade is extendable during use between a closed position located between the spaced apart surfaces of the elongated handle, and an open position substantially in line with the elongated handle;

an elongated lever with a first end and a second end, the first end being pivotally connected to the first end of the blade such that the lever is extendable during use between a first position substantially parallel to and adjacent to the surfaces of the handle and the blade where the blade is in the closed position, and a second position substantially parallel to and adjacent the surfaces of the handle and substantially in line with the blade when the blade is in the open position;

the elongated lever being connected to the blade such that moving the elongated lever from the first position to the second position during use moves the blade from the closed position to the open position; and a blade stop connected to the first end of the handle, the blade stop being adapted to stop the blade from moving to any position except the closed position, the open position, or any position between the closed and the open position.

16. The folding knife of claim 15 wherein the blade has a concave portion proximate the first end the concave portion being adapted to contact the blade stop during use.

17. The folding knife of claim 15, whereby the blade has an end block which engages with the blade stop while in the open position.

18. The folding knife of claim 15, wherein cutting edge of the blade is proximate the elongated lever when the blade is in the closed position and the elongated lever is in the first position.

19. A folding knife, comprising:

an elongated handle comprising a first end, a second end, and a pair of spaced apart surfaces extending between the first end and the second end;

a blade with a first end, a second end, and a cutting edge, the first end of the blade being pivotally connected to the first end of the elongated handle such that the blade is extendable during use between a closed position located between the spaced apart surfaces of the elongated handle, and an open position substantially in line with the elongated handle;

an elongated lever with a first end and a second end, the first end being pivotally connected to the first end of the blade such that the lever is extendable during use between a first position substantially parallel to and adjacent to the surfaces of the handle and the blade when the blade is in the closed position, and a second position substantially parallel to and adjacent the surfaces of the handle and substantially in line with the blade when the blade is in the open position;

the elongated lever being connected to the blade such that moving the elongated lever from the first position to the second position during use moves the blade from the closed position to the open position;

whereby the lever is connected such that the cutting edge of the blade is proximate but does not touch the lever when the blade is in the closed position and the lever is in the first position; and whereby the lever comprises a hump which abuts with the blade at least rearwardly of the cutting edge to retain the spacing between the cutting edge and the lever.

20. A folding knife, comprising:

an elongated handle comprising a first end, a second end, and a pair of spaced apart surfaces extending between the first end and the second end;

a blade with a first end, a second end, and a cutting edge, the first end of the blade being pivotably connected to the first end of the elongated handle such that the blade is extendable during use between a closed position located between the spaced apart surfaces of the elongated handle, and an open position substantially in line with the elongated handle;

an elongated lever with a first end and a second end, the first end being pivotably connected to the first end of the blade such that the lever is extendable during use between a first position substantially parallel to and adjacent to the surfaces of the handle and the blade when the blade is in the closed position, and a second position substantially parallel to and adjacent the surfaces of the handle and substantially in line with the blade when the blade is in the open position;

the elongated lever being connected to the blade such that moving the elongated lever from the first position to the second position during use moves the blade from the closed position to the open position;

whereby the blade further comprises a support bracket located proximate the first end of the blade, the first end of the lever being pivotably connected to the support bracket; and a locking mechanism on the second end of the handle, the second end of the lever being adapted to lock into the locking mechanism when manually pressed against the locking mechanism.

* * * * *